United States Patent [19]

Johnson et al.

[11] 4,409,092

[45] Oct. 11, 1983

[54] COMBINATION PROCESS FOR UPGRADING OIL PRODUCTS OF COAL, SHALE OIL AND CRUDE OIL TO PRODUCE JET FUELS, DIESEL FUELS AND GASOLINE

[75] Inventors: Charles A. Johnson, Ashland; Clifford Ward, Louisa; Howard F. Moore, Ashland; Jr. Hettinger, Russell, all of Ky.

[73] Assignee: Ashland Oil, Inc., Ashland, Ky.

[21] Appl. No.: 307,468

[22] Filed: Oct. 1, 1981

Related U.S. Application Data

[63] Continuation-in-part of Ser. No. 138,237, Apr. 7, 1980, abandoned.

[51] Int. Cl.[3] ..... C10G 45/00; B07B 1/06

[52] U.S. Cl. ..... 208/89; 208/70; 208/98; 208/212; 208/254 H; 208/279

[58] Field of Search ..... 208/61, 89, 98, 114, 208/145, 251 H, 254 H, 216 PP, 15, 18, 28, 58, 59, 60, 69, 97, 211, 212

[56] References Cited

U.S. PATENT DOCUMENTS

| | | | |
|---|---|---|---|
| 2,847,362 | 8/1958 | Kemp | 208/279 |
| 2,944,063 | 7/1960 | Paulsen | 208/279 |
| 2,971,906 | 2/1961 | Webster | 208/254 |
| 3,052,742 | 9/1962 | Mills | 260/674 |
| 3,085,061 | 4/1963 | Metrailer | 208/254 H |
| 3,123,550 | 3/1964 | Skomoroski et al. | 208/279 |
| 3,132,087 | 5/1964 | Kelley et al. | 208/15 |
| 3,146,186 | 8/1964 | Leas et al. | 208/15 |
| 3,230,164 | 1/1966 | Williams et al. | 208/144 |
| 3,236,764 | 2/1966 | Herder et al. | 208/89 |
| 3,239,447 | 3/1966 | Reeg et al. | 208/15 |
| 3,523,938 | 10/1970 | Leas | 208/89 |
| 3,540,997 | 11/1970 | Hahn et al. | 208/97 |
| 3,719,587 | 3/1973 | Karchmer | 208/254 |
| 3,726,789 | 4/1973 | Kovach | 208/61 |
| 3,738,931 | 6/1973 | Frawkovich et al. | 208/89 |
| 3,751,360 | 8/1973 | Bernstein | 208/61 |
| 3,753,198 | 8/1973 | Parker | 208/89 |
| 3,761,395 | 9/1973 | Child et al. | 208/89 |
| 3,891,538 | 6/1975 | Walkey | 208/89 |
| 3,910,834 | 10/1975 | Anderson | 208/59 |
| 3,926,785 | 12/1975 | Siegel | 208/212 |
| 4,003,829 | 1/1977 | Burger et al. | 208/251 H |
| 4,090,951 | 5/1978 | Smith | 208/254 H |
| 4,141,820 | 2/1979 | Sullivan | 208/251 H |
| 4,159,241 | 6/1979 | Simo | 208/251 H |
| 4,159,935 | 7/1979 | Scott | 208/59 |
| 4,159,940 | 7/1979 | Smith | 208/254 H |
| 4,231,858 | 11/1980 | Seitzer et al. | 208/89 |

FOREIGN PATENT DOCUMENTS

| | | | |
|---|---|---|---|
| 790658 | 2/1958 | United Kingdom | 208/279 |

OTHER PUBLICATIONS

Steere et al., Tar Sands Products Bring Changes, Hydrocarbon Processing, Sep. 81, pp. 263–268.

*Primary Examiner*—Gary P. Straub

*Attorney, Agent, or Firm*—Richard C. Willson, Jr.; Carl D. Farnsworth

[57] ABSTRACT

A combination process for upgrading hydrocarbon fractions obtained from raw shale oil, oil products of coal processing and select fractions of crude oils comprising sulfur, nitrogen and metal contaminants to produce jet fuel product fractions such as JP4, JP5, JP8 and other turbine-type fuel materials provided. The combination of integrated processing steps involving hydrotreating, acid extraction of basic nitrogen compounds and hydrofining thereof to produce a feed composition suitable for catalytic reforming in the absence of significant hydrocracking whereby jet fuel boiling range material is produced significantly reduces by the combination the hydrogen requirements of the process. A further significant contribution to the combination operation resides in the utilization of a catalytic cracking operation of restricted severity to particularly convert high-boiling portions of the hydrocarbon feed fractions to product boiling in the jet fuel boiling range desired before acid extraction of basic nitrogen compounds and further refining thereof as above provided by hydrotreating, reforming and hydrofining of the select product of the reforming operation. Thus, the combination operation of the invention substantially maximizes the yield of desired jet fuel products under hydrogenating conditions particularly conserving the consumption of hydrogen.

19 Claims, 1 Drawing Figure

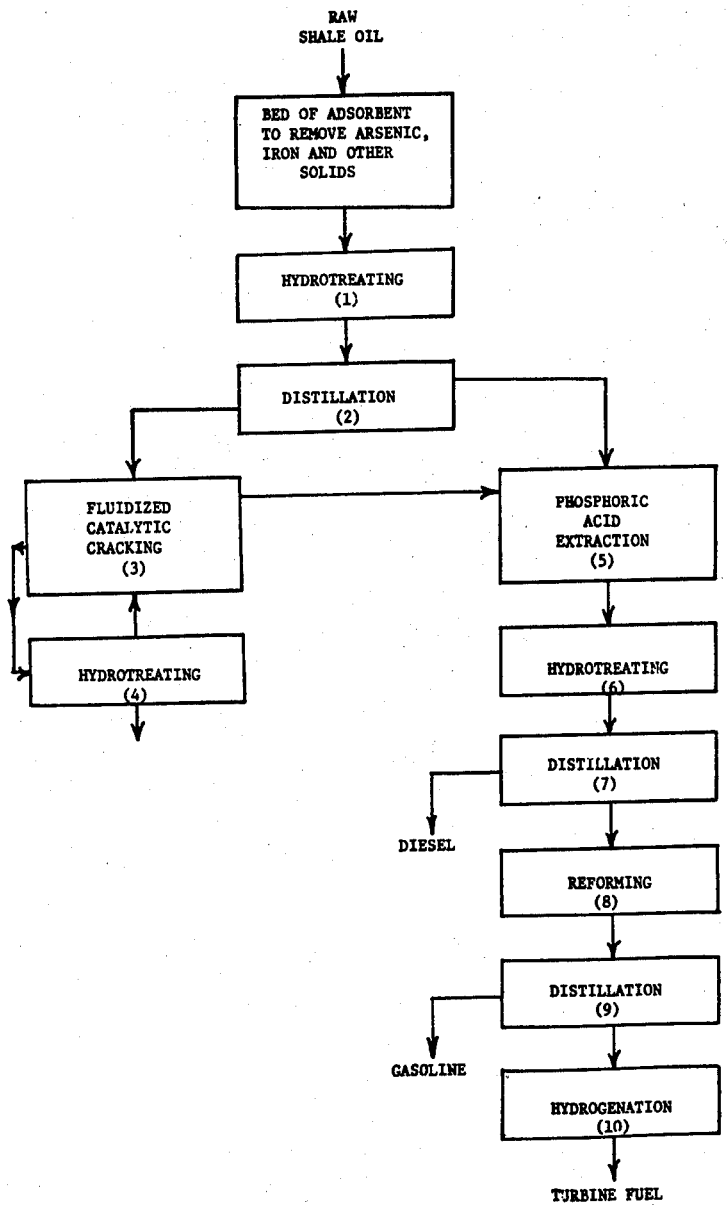
RAW
SHALE OIL
BED OF ADSORBENT TO REMOVE ARSENIC, IRON AND OTHER SOLIDS
HYDROTREATING (1)
DISTILLATION (2)
FLUIDIZED CATALYTIC CRACKING (3)
HYDROTREATING (4)
PHOSPHORIC ACID EXTRACTION (5)
HYDROTREATING (6)
DISTILLATION (7)
DIESEL
REFORMING (8)
DISTILLATION (9)
GASOLINE
HYDROGENATION (10)
TURBINE FUEL

COMBINATION PROCESS FOR UPGRADING OIL PRODUCTS OF COAL, SHALE OIL AND CRUDE OIL TO PRODUCE JET FUELS, DIESEL FUELS AND GASOLINE

This application is a continuation-in-part of Ser. No. 138,237, filed Apr. 7, 1980, now abandoned.

TECHNICAL FIELD

The present invention is concerned with a method and combination of processing steps for producing jet fuels from hydrocarbon materials derived from oil shale, coal and crude oil. It is particularly concerned with a combination operation comprising catalytic cracking restricted to particularly produce jet fuel boiling range materials prior to extraction removal of nitrogen compounds by acid extraction in combination with selected catalytic hydrogenation and reforming designed to particularly emphasize the production of fuels boiling above gasoline and of a composition readily hydrogenated to produce a combustion fuel such as diesel fuel and jet fuels of acceptable chemical and physical characteristics dictated by the aircraft industry.

BACKGROUND ART

In view of the significant price increases in petroleum oils in the last few years along with the increased demands for turbine fuels and particularly aircraft fuels, renewed attention has been focused on the recovery of oil from sources other than crude oil such as oil shale, coal and the subsequent conversion of the oil sources to usable, valuable, combustible transportation fuel products and particularly jet fuel products.

A number of differences exist between various petroleum oils depending on source and oils derived from oil shale, coal and crude oil. One significant difference is the amount of various sulfur, nitrogen and metal contaminants present in the oil. Petroleum oils contain up to about 0.05% by weight of nitrogen, whereas shale oils generally contain at least about 0.5% and mainly at least about 1% by weight of nitrogen. These quantities of nitrogen if not significantly reduced prior to catalytic processing such as by catalytic reforming and catalytic cracking can cause significant processing problems. The nitrogen tends to poison and/or reduce catalyst activity used in such processes. In addition, the burning of oils containing such quantities of nitrogen as well as sulfur is a problem from an ecological viewpoint, since the burning produces nitrous oxide and sulfur oxides. Only very restricted amounts of such oxide are permitted to be exhausted into the atmosphere. Furthermore, the presence of nitrogen in the finished fuel is undesirable since nitrogen compounds tend to cause thermal instability of the finished fuel.

One method employed to reduce the nitrogen content of heavy oils obtained from crude oil and shale oil has been to subject the shale oil to hydrotreating using a suitable hydrogenation catalyst. However, such processes in order to remove sufficient quantities of bound nitrogen have required relatively severe hydrogenation operations of high hydrogen consumptions such as up to 3000 standard cubic feet per barrel (SCF/B) and more generally at least about 1200 SCF/B of hydrogen at relatively high temperatures and pressures. Accordingly, such processes have been quite expensive in order to reduce the nitrogen component to an acceptable low level to withstand the temperature and pressure conditions found necessary.

The use of various acids such as sulfuric, hydrofluoric, hydrochloric, nitric and phosphoric acid to extract nitrogen compounds from oils has been suggested by the prior art, but have been less than completely satisfactory because of hydrogen consumption and an oil product yield of less than desired volume. This unsatisfactory condition is also due in part to the fact that, not all of the nitrogen compounds as initially contained in the oil feed are considered basic nitrogen compounds or are extractable with mineral acids, and particularly, all are not extractable with the acid particularly desired to be employed according to the present invention. For instance, *Chemical Abstracts* Vol. 44-7518(d) describes at least three classes of nitrogen compounds which are recognized as being contained in crude shale oil. Besides basic nitrogen compounds which are extractable with relatively weak acids, crude shale oil also contains varying amounts of nitrogen compounds which are insoluble in weak acids, and which are polymerized by strong acids; and compounds which are stable for example to concentrated sulfuric acid and are not extracted thereby. Accordingly, various processes have been suggested in the prior art employing different acids in combination with other treating steps as discussed below with varying degrees of success.

For instance, U.S. Pat. No. 2,692,226 to Smith suggests treating shale oil by hydrogenation with a catalyst composed of a mixed sulfide of nickel and tungsten or nickel and molybdenum. The hydrogenation employed is relatively severe as shown by the reaction conditions employed. The hydrogenation as suggested by Smith results in a substantial removal of the nitrogen content of the oil as illustrated in the table on column 3 thereof. Smith further suggests treating the hydrogenated material to improve its color by a mild acid treatment with sulfuric acid. The hydrotreating step suggested by Smith should be severe enough so as to saturate aromatics and olefins to prevent the loss in yield discussed therein. Sulfuric acid tends to cause polymerization of the olefins and to remove the aromatics along with nitrogen compounds. Accordingly, Smith seems to suggest that a large portion of the nitrogen could not be removed by the acid treatment without a great loss in yield. Nowhere does Smith suggest any preference for phosphoric acid, and in fact, the use of sulfuric acid therein tends to suggest a preference for sulfuric rather than phosphoric acid. Moreover, Smith does not indicate that the use of phosphoric acid would provide different results than sulfuric acid.

U.S. Pat. No. 3,085,061 to Metrailer suggests a process for refining shale oil which includes a mild hydrotreatment to remove sulfur followed by treatment with anhydrous hydrogen chloride to form a sludge containing substantially all of the nitrogen. Metrailer further suggests that solvents previously employed in shale oil refining which removed undesirable nitrogenous materials were unselective and removed desirable cracking constituents as well. Accordingly, Metrailer would tend to lead persons skilled in the art away from the present invention since among other things it would be contrary to the suggestions of Metrailer to employ an aqueous phosphoric acid system.

Besides Metrailer, there exists a number of other prior art patents which would tend to lead persons skilled in the art away from the phosphoric acid employed according to the present invention. For instance, U.S. Pat.

No. 3,309,324 to McAllister et al. suggests the use of certain weak acids to extract nitrogenous compounds from various oils. McAllister et al. suggest that the use of strong mineral acids such as sufuric acid and hydrochloric acid results in certain disadvantages. These disadvantages suggested by McAllister et al. include the tendency of the strong acids to polymerize unsaturated hydrocarbons which are frequently present in petroleum distillates, and to extract constituents which because of their anti-knock prospects are more advantageously left in for motor fuels. The present invention does not suffer from these disadvantages.

U.S. Pat. No. 2,966,450 to Kemberlin, Jr. et al. suggests a process for refining shale oil which includes using a selective solvent and anhydrous hydrogen chloride. Kemberlin, Jr. et al. suggests that solvents previously employed in shale oil refining, including strong acids such as sulfuric acids and weak acids such as sulfurous acid gave unsatisfactory results, either because of ineffectiveness or poor selectivity, (e.g. resulting in removal of desirable cracking constituents along with the nitrogenous materials).

U.S. Pat. No. 2,662,843 to Castner et al. suggests a process for refining shale oil which includes using formic acid preferably after a mild thermal cracking. Castner et al. further suggests that solvents previously employed in general were not sufficiently selective and removed desirable substances such as aromatics.

U.S. Pat. No. 2,541,458 to Berg suggests aqueous solutions of various volatile acids or salts of non-volatile acids to recover nitrogen bases from shale oil but does not specifically suggest employing non-volatile acids such as phosphoric acid required by the technique of the present invention, and does not suggest cracking a portion of the oil feed prior to acid extraction of basic nitrogen components to extend the yield of desired turbine fuel products.

U.S. Pat. No. 2,513,353 to McKinnis suggests removal of nitrogen compounds from oils including shale oil and shale oil fractions with an extractant containing acid, ammonium or amino or salts of strong non-volatile acids, such as salts of phosphoric acid. The examples of said patent suggest mixtures of free phosphoric acid with the required extractant compounds. However, this patent would actually tend to lead persons skilled in the art away from the present invention since among other things there is no suggestion in this patent to employ a mild hydrogenation step before a restrained catalytic cracking step and prior to the particular acid extraction of the nitrogen compounds as disclosed by the present invention.

The discussion in *Chem. Abstracts* 44-7518(d) suggests the removal of certain nitrogen compounds from shale oil employing dilute mineral acids. However, such limited disclosures does not remotely suggest the integrated combination process of this invention comprising a restrained catalytic cracking step prior to acid extraction and subsequent reforming of a mildly hydrogenated product thereof as required by the present invention.

U.S. Pat. No. 3,123,550 to Skomoroski et al. suggests mixing a shale oil distillate with an acid such as phosphoric acid, and then hydrotreating the mixture. The acid is suggested as aiding in increasing the catalyst surface available for hydrogen adsorption (see column 1, lines 49–61 for instance).

U.S. Pat. No. 2,035,583 to Bailey suggests a process for separating and purifying nitrogen bases which includes use of various acids. However, there is no disclosure of the phosphoric acid extraction steps in the integrated combination process according to the present invention.

U.S. Pat. No. 2,084,617 to Chellis et al. is concerned with reducing the nitrogen content of naphthas prior to reforming. Chellis et al. suggest mild hydrotreating followed by treatment with sulfuric acid followed by mild hydrotreating followed by another treatment with sulfuric acid, which latter process is preferred by Chellic et al. for shale oil naphthas.

U.S. Pat. No. 2,800,427 to Junk, Jr. et al. suggests pretreating hydrocarbon oils prior to catalytic cracking with a non-oxidizing acid such as sulfuric acid and hydrochloric acid.

U.S. Pat. No. 2,925,381 to Fleck et al. suggests removing organic nitrogen compounds from hydrocarbons such as shale oil by using a zeolite.

An object of this invention is to improve the production of jet fuel, particularly military jet fuel, from one or a combination of oil fractions such as shale oil, an oil product of coal processing and select crude oil fractions under conditions of low cost and minimum consumption of hydrogen. Jet fuels suitable for military use have a number of specific properties which must be met.

The specific properties include an API gravity restriction, volumetric distillation temperatures including initial and end boiling points, freeze point, flash point, luminoscity number, thermal stability, aromatic concentration, the IPT smoke point, the analine point and the concentration of sulfur and nitrogen contaminants.

A series of complex processing operations are required to achieve these desired jet fuel properties which vary with jet fuel desired, JP4, JP5, JP8, etc. A further object of this invention is to maximize the yield of jet fuel from the oil feed by providing a process combination which facilitates the economic production of the turbine fuel product desired in high yields from distress stocks. Certain jet fuels have a very low initial boiling point with an end point specified to fall within the range of 350° up to about 450° F. Other turbine fuels have a higher initial boiling point with an end boiling point of at least about 550° F. or greater. In the combination process of this invention a separated initial hydrotreated product has an end point within the range of 500°–650° F. separated from higher boiling material subsequently cracked as herein provided in order to obtain as much jet fuel as possible from selected oil feeds; such as JP4, JP5 and JP8, jet fuels or others. Conversion of a broad range of feed stock to form jet fuels is extremely desirable during periods of crude oil scarcity, military emergency and/or for other fuel purposes.

DESCRIPTION OF INVENTION

A general description of the combination process of this invention is as follows.

Oil feed materials obtained from crude oils, coal and shale oil boiling up to about 1000° or 1050° F. and containing a considerable amount of sediment fines, metal contaminant materials such as iron, copper, nickel, vanadium, sulfides thereof and other materials which would tend to plug a catalyst bed, and arsenic, which is a poison for hydrotreating and reforming catalysts and other catalysts utilized in the process. These metal contaminants are first at least partially removed from the oil feedstock by passing through a bed of adsorbent material of high surface area with or without added hydrogen as a metals hydrocleaning operation. Two or more of these adsorbent material metals removal beds can be operated in parallel or in the well known swing fashion so that one bed can be on steam for removing material contaminants while the other is being reconditioned. It is also contemplated using a moving mass of adsorbent particle solid contact material as in a moving bed or fluid bed contact operation. The effluent product obtained from this metals hydrocleaning operation is then hydrogenated by passage through a bed of cobalt or nickel moly catalyst or other suitable hydrotreating catalyst such as nickel-tungsten in order to further remove sulfur, oxygen, metals and a substantial amount of nitrogen under the conditions employed. More importantly, this preliminary hydrotreating step is effected under hydrogen consumption conditions selected for converting most of the nitrogen compounds to basic nitrogen compounds. The purpose of this hydrotreating operation is to particularly condition the nitrogen compounds to basic nitrogen compounds without consuming excessive hydrogen so that they may be more easily extracted in an acid extraction process. This is one of the unique features of the combination process of this invention. The product of the mild hydrotreating operation, preferably of wide boiling range, is then distilled to obtain and recover a light fraction with an end point boiling in the desired range of 600° to 650° F. The bottom portion of this distillation operation boiling above the end boiling point range is sent to catalytic cracking employed under conditions to particularly produce products boiling above gasoline products. That is, the severity of the catalytic cracking operation is selected and maintained to particularly optimize the yield of cracked products suitable for preparation of jet fuels therefrom.

The catalytic cracking operation preferably a fluid catalytic cracking operation, is carried out under temperature and velocity conditions selected to minimize the production of light ends in preference to kerosene and higher boiling light cycle oil hydrocarbons. The primary objective of the cracking operation is to convert the oil feed material boiling above an end point in the range of 600° F. to 650° F. to a material boiling below that temperature range and suitable for producing jet fuels. For example, if it is sought to maximize the production of JP4, the end cut point employed in distillation of the initially hydrotreated feed is in the range of 450°-600° F., with the bottom product of distillation being passed to the catalytic cracker operation and having an initial boiling point in the range of 550°-600° F. On the other hand, the separation of the mildly hydrotreated oil feed by distillation may be effected so that a higher initial boiling point material, boiling above 650° F. may be utilized in the cracking operation. The product obtained from catalytic cracking is fractionated to obtain gasoline component material and lower boiling materials from jet feed boiling range materials and heavy cycle oils. The catalytic cracking operation is also a metals removal operation as well as effecting removal of sulfur and nitrogen. The cracking operation may be relied upon for removing about 40% of the basic nitrogen compounds formed by the mild hydrotreating operation prior thereto. A separated and recovered jet fuel producing boiling range product of catalytic cracking is sent to an acid extraction step alone or with the 650° F. minus material recovered from the hydrotreated product as above described. The product obtained from catalytic cracking and hydrotreating as above provided is one boiling in a broad range and particularly desirable for jet fuel production but still contains basic nitrogen compounds, some sulfur and oxygen compounds, as well as olefins not hydrogenated and produced by catalytic cracking. This product also contains amounts of long chain normal paraffins considered to be waxy materials and sufficient to deleteriously affect the freeze point of jet fuel by settling out as microcrystalline material unless appropriately treated. Select jet fuel producing fractions obtained from the mild catalytic cracking operation and from the mild hydrotreating operation upstream thereof are then sent to an acid extraction process. Various acids such as $H_2SO_4$, $HNO_3$, HF, HCl and $H_3PO_4$ have been proposed for hydrocarbon extraction processes. Phosphoric acid is considered superior in the process of this invention since it avoids problems of undesirable corrosion encountered with hydrochloric acid and formation of the sulfonates if sulfuric acid were used. The hydrotreating process for basic nitrogen compounds produces ammonia, which can be recovered easily and subsequently used to spring the phosphoric acid acid extract free from the accumulated nitrogen-containing compounds, thus producing ammonium phosphate. The phosphoric acid extraction process also provides the additional advantage of subsequently producing ammonium phosphate from the acid extract phase which can be used as a fertilizer. A useful product is thus produced rather than a waste product, as would be more prevalent in utilizing either hydrochloric acid or sulfuric acid.

The raffinate hydrocarbon product of reduced nitrogen obtained from the phosphoric acid extraction step comprises a hydrocarbon product boiling in a desirable turbine fuel boiling range comprising some residual sulfur, nitrogen, olefins, a small amount of arsenic, and paraffins. This raffinate hydrocarbon product is hydrotreated in order to further reduce these impurities to a lower level and to prepare a feedstock for use in the novel reforming operation of this invention at unique operating conditions so as to bring about the reactions of dehydrogenation, hydrogenation, dehydrocyclization, osomerization, aromatization, and very little if any hydrocracking. This selective reforming operation is designed and operated to produce a product blend of paraffins, aromatics and naphthenes which are acceptable components for producing various jet fuels. Since the unique reforming step of the invention process produces aromatics beyond the maximum allowed in jet fuels, there is provided a final hydrofining operation designed to particularly hydrogenate aromatics and olefins to an acceptable low level for recovery of desired jet fuel product.

BRIEF DESCRIPTION OF THE DRAWING

The drawing is a schematic block flow diagram of a sequence of steps particularly suitable for preparing combustion fuels by the unique process of this invention and comprising gasoline, diesel fuels and aviation turbine fuel from one or a combination of oil feeds obtained from shale oil, coal oil and crude oil.

DISCUSSION OF SPECIFIC EMBODIMENTS

The unique combination process of this invention permits upgrading to jet fuels, gasoline and higher boiling diesel oils from oil fractions rich in nitrogen, sulfur, and metal contaminants comprising arsenic, iron, nickel, vanadium and copper. It thus permits the upgrading of poor quality crude oils, oil products of coal processing and particularly fractions of shale oils. It is also contemplated blending two or more of these oil feed sources to provide increased yields of desired jet fuel products and higher boiling liquid fuels of acceptable composition.

The shale oil product which can be upgraded according to the present invention is any shale oil material and distillate portion thereof suitable for producing turbine fuels which generally contain more than about 0.1% by weight and usually at least about 0.5% by weight of nitrogen compounds.

The oil feed materials treated pursuant to the unique combination process of the present invention may boil in the range of about 100° F. to about 1200° F. and more usually below about 1050° F.

Since the oil feed materials contemplated for use by this invention comprise metal contaminants above identified it is preferred that the feeds be initially contacted with a solid sorbent material at a temperature in the range of about 300° F. to about 500° F. but below thermal cracking temperatures either with or without the presence of added molecular hydrogen to effect primarily a removal of metal contaminants and some removal of sulfur and nitrogen material. Any solid sorbent material may be used for this purpose including spent cracking catalyst, clays and other inert materials suitable for the purpose.

Reference to the block flow drawing will help to illustrate by way of example, the unique combination process of the present invention. According to a preferred embodiment, a raw oil feed such as crude shale oil is subjected after the sorbent metals removal step to a first relatively mild hydrotreating operation designated as step 1. The total hydrogen consumption of this relatively mild hydrotreating step may be up to about 1200 SCF/B of oil. A minimum hydrogen consumption is substantially restricted to that amount needed to substantially saturate non-benzenoid unsaturated materials such as the olefins and diolefins in the feed oil, to effect some sulfur and nitrogen removal, and to increase particularly basic nitrogen compounds in the oil feed. A minimum hydrogen consumption is generally at least about 50 SCF/B.

The first mild hydrotreatment step 1 is provided to also remove a substantial amount of the sulfur and any remaining arsenic present in the shale oil following the sorbent contact step. As discussed hereinabove, the shale oil initially contains nitrogen compounds other than basic nitrogen compounds which are not readily extractable with an acid such as aqueous phosphoric acid. However, it has been observed that this mild first hydrotreating step, although not removing a large quantity of nitrogen compounds, substantially increases the ratio of basic nitrogen compounds to the total nitrogen remaining in the oil feed. Therefore, this first hydrotreating step is designed and operated to particularly cause conversion of nitrogen materials which are not extractable with phosphoric acids into basic nitrogen materials which are more easily extractable with aqueous phosphoric acids. This first mild hydrotreating operation also removes up to about 30% by weight and generally at least about 15% by weight of the nitrogen initially present in the oil.

The employment of a relatively mild first hydrotreatment step is also quite advantageous from an economic viewpoint in that the needed hydrogen for such hydrotreatment can be reduced substantially as compared to that required in carrying out a more severe hydrotreating operation. This first hydrotreatment step is particularly advantageous since the nitrogen content of the feed is reduced to some considerable extent which in turn lessens the detrimental effect of nitrogen in the high boiling feed portion subjected to cracking as discussed herein. Moreover, it is believed that such hydrotreating provides some nitrogen compounds which are less refractory and thus reduces the overall viscosity of the higher boiling oil feed portion fed to the catalytic cracking operation herein discussed.

The operating conditions selected for this first mild hydrotreating operation to reduce the hydrogen consumption thereof discussed hereinabove, include reactor temperatures in the range of about 350° F. to about 750° F., preferably about 600° F. to about 700° F., and most usually restricted to a temperature of about 625° F. to about 675° F.; a pressure in the range of about 300 to about 2000 psig, preferably up to about 1600 psig, and most usually about 1000 psig; an oil feed liquid hourly space velocity in the range of about 0.5 to about 10, and preferably from about 2 to about 3 at the preferred pressures. The hydrotreating catalysts may be a cobalt-molybdate, nickel molybdate or nickel-tungsten catalyst disclosed in the prior art. The metal components are normally supported on a carrier material such as alumina. Examples of some suitable hydrogenation catalysts are found in the disclosure of U.S. Pat. No. 3,029,230 to MacLaren, the disclosure of which is incorporated herein by reference. The preferred hydrotreating catalyst is a cobalt-molybdate on an alumina support. A suitable catalyst contains on a dry weight basis about 14.0% $MoO_3$, about 3.83% CoO and the balance alumina. Typical physical properties of such a catalyst are as follows:

| Form | Extrudate | |
|---|---|---|
| Size | 1/10"(Nom. 1.8") | 1/16" |
| Surface Area, $m^2$/gm | 250 | 250 |
| Total Pore Volume, cc/gm | 0.55 | 0.55 |
| Density, gm/cc | 0.73–0.74 | 0.73–0.74 |
| Reactor Packed Density lb/$ft^3$ | 41–43 | 41–43 |
| Strength, lbs. crushed | 16–18 | 14–16 |
| Attrition Index* | 97 | 97 |

*Percentage retained on a 20-mesh sieve after tumbling for one-half hour.

The first hydrotreating operating conditions are selected to provide a relatively mild hydrotreatment of the feed. For instance, the higher the pressure used, the higher the space velocity should be to provide a mild treatment. In particular, above about 1200 psig the space velocity should desirably be at least about 2; at about 1600 psig the space velocity is preferably at least about 5.

A typical hydrotreating operation to conserve hydrogen according to the present invention involves the following conditions:

| | |
|---|---|
| inlet temperature | 652° F. |
| pressure | 1000 psig |
| liquid hourly space velocity | 1.96 |
| hydrogen flow rate | 5096 SCF/B |
| chemical hydrogen consumption | 772 SCF/B |

An analysis of a typical shale oil before and after such a hydrotreating step is as follows:

| Before Hydrotreating | |
|---|---|
| Gravity, °API | 22.9 |
| Sulphur, PPM | 7180 |
| Nitrogen, PPM | 10470 |
| Carbon Weight Percent, | 84.97 |
| Hydrogen Weight Percent, | 11.64 |
| Arsenic, PPB | 13700 |
| Pour Point, °F. | + 60 |
| Oxygen, .838% (wt) | |
| **After Hydrotreating** | |
| Gravity, | 27.4 |
| Sulphur, | 910 PPM |
| Nitrogen, | 9460 PPM |
| Arsenic, | 1 PPM |
| Pour Point, °F. | + 70 |
| Oxygen, .413% (wt) | |

The initially hydrotreated shale oil material is then subjected to a distillation operation, designated as step 2, to obtain select fractions thereof comprising an overhead or light shale oil distillate fraction of an end boiling point in the range of 600° to 650° F. separated from higher boiling material. For instance, when the ultimate product is to be a relatively high boiling turbine fuel, the overhead distillate fraction can include materials which boil up to about 650° F.; whereas, when the ultimate product is to be a jet fuel such as JP4, JP5 or JP8, the overhead distillate fraction preferably includes materials boiling below about 550° F. If desired, the entire hydrotreated feed oil or substantially any high boiling fraction thereof to be converted to lower boiling desired product can be subjected to the catalytic cracking step designated as step 3. The catalytic cracking operation of step 3 is preferably a selective operation designed and operated to particularly provide more jet fuel boiling range material from portions of the oil feed boiling above 600° F. and remove basic nitrogen compounds as herein discussed.

The catalytic cracking operation is preferably a fluidized catalysts cracking process which employs any of the well-known cracking catalysts suitable for the restrained operation herein desired. Activated clays or silica-magnesium catalysts and silica zirconium cracking catalysts, or zeolite catalysts as suggested in U.S. Pat. No. 3,654,141 to Maryland or the layered silicates such as the smectites may be employed. The preferred catalysts include a zeolite-containing cracking catalyst or a silica containing catalyst which will provide a greater amount of middle distillate material with an end boiling point in the range of about 600°-650° F. when subjecting high boiling hydrogenated oil feed to a selective cracking operation suitable for the purpose.

The zeolite-containing cracking catalysts may include any zeolite, whether natural, semi-synthetic or synthetic, alone or in admixture with other material components which do not significantly impair the suitability of the cracking catalyst. For example, if the catalyst is a mixture of cracking components, it may include the cracking component dispersed in a porous refractory inorganic oxide carrier material. Or the catalyst may comprise for example, the zeolite component in the range of about 1% to about 60%, preferably from about 1 to about 40% and most usually from about 5 to about 25% by weight, based on the total weight of catalyst (water free basis). The remaining primary component of the catalyst may be limited to a porous refractory inorganic oxide alone or in combination with various clay materials or known adjuvants for promoting or suppressing various desired and undesired reactions.

The zeolite component of the catalysts will be one known to be useful in FCC cracking processes. In general, these are crystalline aluminosilicates, typically made up of tetra coordinated aluminum atoms associated through oxygen atoms with adjacent silicon atoms in the crystal structure. However, the term "zeolite" as used in this disclosure contemplates not only aluminosilicates, but also substances in which the aluminum has been partly or wholly replaced by another metal such as for instance by gallium, titanium and zirconium and other metal atoms suitable for the purpose. The catalyst may also include substances in which all or part of the silicon has been replaced, such as for instance by germanium.

Most zeolites are prepared or occur naturally in the sodium form, so that sodium cations are associated with the electro negative sites in the crystal structure. The presence of sodium cations is known to make the zeolites less active and less stable when exposed to hydrocarbon conversion conditions, particularly high temperatures. Accordingly, the zeolite may be ion exchanged with ammonia and/or rare earth metals, such ion exchange may occur before and/or after incorporation of the zeolite as a component of the catalyst composition. Suitable cations for replacement of sodium in the zeolite crystal structure include ammonium (decomposable to hydrogen) rare earth metals, alkaline earth metals and combinations thereof. Various suitable ion exchange procedures and cations which may be exchanged into the zeolite crystal structure are well known to those skilled in the art and are a part of this invention to the extent necessary to provide an active cracking for the selective cracking operation of this invention.

Examples of the naturally occurring crystalline aluminosilicate zeolites which may be used as or included in the catalyst for the present invention are faujasite, mordenite, clinoptilite, chabazite, analcite, erionite, as well as levynite, dachiardite, paulingite, noselite, ferriorite, heulandite, scolccite, stibite, harmotome, phillipsite, brewsterite, flarite, datolite, gmelinite, caumnite, leucite, lazurite, scaplite, mesolite, ptholite, nepheline, matrolite, offretite and sodalite.

Examples of the synthetic crystalline aluminosilicate zeolites which are useful as or in the catalyst for carrying out the present invention are Zeolite X, U.S. Pat. No. 2,882,244, Zeolite Y, U.S. Pat. No. 3,130,007; and Zeolite A, U.S. Pat. No. 2,882,243; as well as Zeolite B, U.S. Pat. No. 3,008,803; Zeolite D, Canada Pat. No. 661,981; Zeolite E, Canada Pat. No. 614,495; Zeolite F, U.S. Pat. No. 2,996,358; Zeolite H, U.S. Pat. No. 3,010,789; Zeolite J, U.S. Pat. No. 3,011,869; Zeolite L, Belgian Pat. No. 575,177; Zeolite M, U.S. Pat. No. 2,995,423, Zeolite O, U.S. Pat. No. 3,140,252; Zeolite Q, U.S. Pat. No. 2,991,151; Zeolite S, U.S. Pat. No. 3,054,657, Zeolite T, U.S. Pat. No. 2,950,952; Zeolite W, U.S. Pat. No. 3,012,853; Zeolite Z, Canada Pat. No. 614,495; and Zeolite Omega, Canada Pat. No. 817,915. Also ZK-4HJ, alpha beta and ZSM-type zeolites are useful. Moreover, the zeolites described in U.S. Pat. Nos. 3,140,249; 3,140,253; 3,044,482 and 4,137,151 are also useful, the disclosures of said patents being incorporated herein by reference.

The crystalline aluminosilicate zeolites, such as synthetic faujasite, will under normal conditions crystallize as regularly shaped, discrete particles of approximately 0.5 to 10 microns in size. This is the size range normally used in commercial fluid catalysts preparations. Preferably the particle size of the zeolite is from 1 to 2 microns. However, zeolites prepared in situ from calcined kaolin may be characterized by even smaller crystallites. Blockage of the internal channels by, for example, coke formation and contamination by metals poisoning will greatly reduce the total zeolite surface area. Therefore, to minimize the effect of contamination and pore blockage, crystals larger than the normal size cited above are preferably not used in the catalysts of this invention.

One example of a riser catalytic cracking apparatus suitable for this cracking step is disclosed in U.S. Pat. No. 4,070,159, the disclosure of which is incorporated herein by reference. This type of apparatus contains a chamber for disengagement of the catalyst and vapor discharged from a riser reactor zone which includes means for causing the vapors to undergo a sufficient change of direction relative to the direction travelled by the catalyst particles whereby the vapors are suddenly and effectively separated from catalyst particles before entering a cyclone separation zone.

The catalyst recovered from the cracking step is regenerated and heated for reuse by burning off hydrocarbonaceous deposits to remove nitrogen material which may have been adsorbed. The catalytic cracking operation is generally carried out at temperatures in the range of about 900° to about 1300° F., it being preferred to employ temperatures below about 1050° F. A typical catalytic cracking operation using a zeolite cracking catalyst employed in the combination process of the present invention may include the following conditions:

| | |
|---|---|
| riser temperature at point of exit of oil catalyst | 900–1000° F. |
| catalyst regeneration temperature | 1250–1500° F. |
| feed preheated temperature | 400–750° F. |
| feed rate #/hour | 3 to 5 |
| cat/feed ratio | 10–20:1 |

A full range shale oil having previously been hydrotreated as discussed hereinabove and having a nitrogen content of about 1.02% is subjected to the selective cracking conditions herein desired to produce primarily light cycle oils in preference to gasoline. This cracking operation results in obtaining up to about a 71 volume percent conversion of materials boiling above 570° F. to materials boiling below about 570° F. and suitable for forming turbine fuels. The volume percent conversion is expressed as:

$$100-100 \times \frac{\text{quantity of 570 + material remaining in product}}{\text{quantity of 570 + material in feed to cracker}}$$

A 80°–570° F. cut of the full range shale oil after hydrotreating and before the cracking has a nitrogen content of about 0.94%. A 80°–570° F. cut of the shale oil after cracking has a nitrogen content of only about 0.39%. These nitrogen values indicate that the cracking operation results in substantial removal of nitrogen. It is also important to note that a 80°–570° F. cut of the product of cracking may include some nitrogen compounds in the feed charged to the cracking operation. These additional nitrogen materials are those which have been converted by the cracking from materials boiling above 570° F. to those boiling below about 570° F. The boiling range of the oil feed charged to the catalytic cracking operation may be at least 650° F. plus material so that a cracked product suitable for producing diesel and jet turbine fuels boiling below about 650° F. may be obtained as a product of the selective cracking operation desired by the processing combination of the invention. The catalyst cracking operation of this invention facilitates the removal of undesired nitrogen compounds and render more efficient the extraction of basic nitrogen compounds by the acid extraction step of the invention. This may be due at least in part to the formation of lower molecular weight nitrogen compounds which may be more easily extracted. Also, since the molecular weight of the nitrogen compounds is reduced, the total weight of material needed to be extracted is substantially reduced; thereby providing an efficient operation resulting in reduced amounts of by-product.

The amount of the shale oil or high boiling distillate portion thereof which is fed to the catalytic cracking operation depends upon the product desired as mentioned herein and is usually at least about 20% by weight of the shale oil feed to the process and can be up to 100% of the selected oil feed. It is normally at least about 60 to 80% of the hydrotreated oil feed. The cracked product will contain significant amounts of olefinic and aromatic materials due to the cracking operation.

In the event the initial or first hydrotreating operation above discussed is not carried out prior to the cracking operation, a high boiling bottoms product of cracking separated from lower boiling desired product by distillation can be subjected to a mild hydrotreatment in step 4 employing the conditions discussed herein prior to recycling the hydrogenated material to the fluid catalytic operation.

The catalytically cracked material comprising a distillate portion thereof with an initial boiling point in the range of 114° to 186° F. and an end boiling point in the range of 580° F. to about 650° F. is then subjected to the acid extraction step of the process with aqueous phosphoric acid as herein described. This material can be recovered as a cracked product or hydrotreated and recycled to the catalytic cracking operation to produce additional cracked product in the jet fuel boiling range. The catalysts employed in the hydrotreating step 4 of the process may be a colbalt-molybdenum, a nickel-molybdenum or a nickel-tungsten catalyst commercially available and known in the art. A nickel-molybdenum catalyst on an aluminum support is identified as having the following properties:

| TYPICAL CHEMICAL ANALYSIS, WT. %, DRY BASIS | |
|---|---|
| $MoO_3$ | 19.0% |
| NiO | 5.4% |
| Aluminum Base | Balance |

| TYPICAL PHYSICAL PROPERTIES | | |
|---|---|---|
| Form | Extrudate | |
| Size | 1/10"(Nom. ⅛") | 1/16" |
| Surface Area, $m^2$/gm | 170 | 170 |
| Total Pore Volume, cc/gm | 0.43 | 0.43 |
| Density, gm/cc | 0.88–0.90 | 0.88–0.90 |
| Reactor Packed Density, lb/$ft^3$ | 51–55 | 51–53 |
| Strength, lbs crush | 16–18 | 14–16 |
| Attrition Index* | 97 | 97 |

*% retained on a 20-mesh sieve after tumbling for one-half hour.

The hydrogenated shale oil or selected distillate portions thereof and the catalytically cracked oil or select distillate portions thereof are separately or admixed subjected to extraction with an aqueous solution of phosphoric acid designated as step 5 to effect removal of base nitrogen compounds. The extraction is preferably conducted by a countercurrent flow operation wherein the aqueous phosphoric acid is introduced into the upper part of a contact tower for downflow therein and the oil is pumped into the lower portion of the tower for upward flow towards the upper portion of the contact tower. The aqueous acid phase containing the extracted nitrogen materials is removed at the lower part of the tower with the acid extracted oil being removed from the upper part thereof. Examples of suitable extraction towers include rotary disc towers, sieve tray towers, and packed towers.

The amount of acid employed is generally at least about 0.3 parts by weight per 100 parts by weight of the oil being treated, and preferably about 0.5 to about 5 parts by weight per 100 parts by weight of the oil being treated. Usually, amounts greater than about 50 parts by weight of phosphoric acid per 100 parts by weight of the oil being treated are not necessary. For the maximum practical and economical considerations, about 0.5 to about 7 parts by weight of acid are employed per 100 parts by weight of the oil, although as little as 3 parts by weight of acid can sometimes be used depending on the nitrogen content of the fuel.

The acid extraction step is generally carried out at about room temperature and atmospheric pressure. However, higher or lower pressure and temperature severity conditions can be employed if suitable and desired. In addition, it may be desirable to employ elevated temperature such as up to about 150° F. in order to facilitate better flowing of the oil distillate. It is of course understood, that the acid composition employed should not be miscible with the oil to any significant extent. The extraction step is carried out in such a manner as to ensure intimate contact between the acid and oil. Such is achievable by use of the types of apparatus referred to hereinbefore.

The concentration of the acid in the aqueous composition can vary over a wide range. The use of very concentrated acid solutions, although suitable, are not especially preferred since the contact with the oil becomes increasingly difficult as the concentration increases and the total volume of aqueous acid composition therefore decreases. Acid concentrations, up to about 85% by weight may be employed and are quite suitable on some operations with concentrations in the range of about 5 to about 55% by weight being more usually employed. A concentration of about 42 wt% is considered about ideal in the acid extraction step.

The hydrogenated and cracked oil feed charged to acid extraction contains significant amounts of olefins due primarily to the cracking operation (e.g.—in many cases at least about 2 to about 5% by weight) and significant amounts of aromatics depending on the severity of the cracking operation employed. It has been found according to the present invention that the use of phosphoric acid does not result in any significant polymerization of the included olefins or dissolution of the aromatics as would be expected from experience with sulfuric acid. In fact, the prior knowledge that sulfuric acid polymerizes olefins and dissolution of aromatics would lead persons skilled in the art to reduce the olefin and aromatic content of the feed to acid extraction to as low a value as possible prior to acid extraction thereof. If desired, the extraction can include a plurality of extraction steps which can employ somewhat different conditions tailored to preferentially effect certain types of material such as the olefins in one step and then to preferentially effect another type of material such as the naphthenes in another extraction step during nitrogen compound extraction.

The acid employed is preferably phosphoric acid, since the use of other acids will not provide the results desired in the combination process of the present invention. In particular, the use of sulphuric acid could cause significant damage to the hydrocarbon being treated and loss of desired product as discussed hereinabove. Acetic acid is not deemed desirable since such could result in esterification of the materials being treated. Furthermore, the use of hydrochloric acid could result in reaction with the hydrocarbons and is therefore undesirable from this standpoint. Moreover, the use of hydrochloric acid suffers from corrosion problems which necessitate the use of equipment made from special corrosion resistance materials which significantly increase the cost. Still further, as apparent from the prior art, the use of the acids employed therein resulted in formation of sludge which must be disposed of and from which it is not practical to recover the acid or convert it to a useful form. Disposal of such formed sludge is a critical problem. The sludge formation which has been experienced when using mineral acids other than that required by the present invention such as HCl and $H_2SO_4$ is believed to be a result of such acids causing the polymerization of certain materials present in the oil feed.

On the other hand, the present invention makes it possible to readily separate the acid from the treated materials by merely adding ammonia to the aqueous phase after use to result in the preparation of a useful material such as ammonium phosphates which will precipitate out and which subsequently can be employed as a fertilizer. The ammonia employed to produce, for instance, ammonium phosphates can be separated ammonia which is produced in the hydrotreating steps of the process. The ability to produce useful materials such as ammonium phosphates and the increased economics obtained thereby from the sale and/or beneficial use thereof further enhances the commercial and economic attractiveness of the combination process of the present invention. Formation of undesirable sludge does not occur employing the processing concepts of the present invention.

The select boiling range product obtained from the catalytic cracking operation and having a nitrogen content of about 0.39% may be separately contacted with an aqueous $H_3PO_4$ solution of about 53.3% acid concentration. About 3 parts of acid are employed per 100 parts of the catalytically cracked product. The product of cracking after separation from the aqueous acid solution has a nitrogen content of only about 0.05% by weight. Thus, it is contemplated separately acid treating the 650° F. minus product of hydrotreating step 1 before blending with an acid treated select product fraction of catalyst cracking.

The following table illustrates the results obtained when subjecting a shale oil distillate boiling below 650° F. after initial hydrotreating to the different acid concentrations stated in the table. The dosage employed is about 3.0 grams $H_3Po_4$ (100% acid basis)/100 grams of oil distillate. Nitrogen determinations are run on the raffinates from each extraction. The total nitrogen content prior to extraction is 0.2476 and the basic nitrogen prior to extraction is 0.2362.

TABLE 1

| Sample No. | Sample | Acid Conc. | Total Nitrogen Before Ext. | Total Nitrogen After Ext. | Total Nitrogen Wt. % Ext. | Basic Nitrogen Before Ext. | Basic Nitrogen After Ext. | Basic Nitrogen Wt % Ext. |
|---|---|---|---|---|---|---|---|---|
| 1 | Full Range | — | .2625 | — | — | .2299 | — | — |
| 2 | 650° F.+ | — | .3800 | — | — | .2705 | — | — |
| 3 | 650° F.− | — | .2476 | — | — | .2362 | — | — |
| 4 | Raffinate 650° F.− | 53.5 | — | 0.0868 | 64.9 | — | 0.0355 | 85.0 |
| 5 | Raffinate 650° F.− | 45.0 | — | 0.0900 | 63.7 | — | 0.0388 | 83.6 |
| 6 | Raffinate 650° F.− | 36.0 | — | 0.1010 | 59.2 | — | 0.0482 | 79.6 |
| 7 | Raffinate 650° F.− | 18.0 | — | 0.1145 | 53.8 | — | 0.0555 | 76.5 |
| 8 | Raffinate 650° F.− | 6.0 | — | 0.1270 | 48.7 | — | 0.0698 | 70.4 |

In step 6 of the combination process, the combined acid treated select products of cracking and hydrotreating step 1 containing a substantially reduced amount of nitrogen is further subjected to a relatively mild hydrotreating process. The mild hydrotreating operation at this stage of the process is to assure some hydrogenation of the olefins and aromatics in the acid treated oil product before effecting a further separation thereof by distillation. The conditions of this particular mild hydrotreating step 6 are similar to those employed in the initial or first hydrotreating step 1 discussed hereinabove. A catalyst for this hydrotreating step may also be one of cobalt molybdenum or nickel molybdenum. A nickel molybdenum catalyst commercially identified as Aero HDS-3 and Aero HDS-3A has the following properties.

| | HDS-3 | HDS-3A |
|---|---|---|
| Loss on ignition at 900° F., wt. % | 2.0 max | 2.0 max |
| Chemical, wt. % dry basis | | |
| Molybdenum ($MoO_3$) | 14.5–16.0 | 14.5–16.0 |
| Nickel (NiO) | 3.0–4.0 | 3.0–4.0 |
| Sodium ($Na_2O$) | 0.06 max | 0.06 max |
| Iron (Fe) | 0.05 max | 0.05 max |
| Physical Properties | | |
| Average diameter, inches | 0.11–0.13 | 0.055–0.067 |
| Average length, inches | 0.20–0.38 | 0.12–0.25 |
| Poured bulk density, lb/ft$^3$ | 38–44 | 38–44 |
| Crush strength, lb/mm* | 3.0 min | 2.5 min |
| Surface area, m$^2$/gm | 140 min | 140 min |
| Pore volume, cc/gm | 0.50–0.70 | 0.50–0.70 |
| Fines, U.S. Std. Sieve | | |
| −8 mesh, wt. % | 0.5 max | |
| −16 mesh, wt. % | | 0.5 max |
| Loss of Abrasion, wt. % | 3.0 max | 3.0 max |

*Determination made with ⅛" anvil

The product of hydrotreating step 6 is then distilled in step 7 and a high boiling fraction suitable for use as a diesel fuel is recovered when available and desired. A fraction suitable for producing jet fuels as herein desired is recovered from the distillation operation for further processing as by catalytic reforming in the manner herein described and designated in step 8 of the process. The catalytic reforming operation of this invention involves isomerization, cyclization, hydrogenation, dehydrogenation and aromatization. A reforming catalyst suitable for the purpose is a platinum or other known noble metal catalyst which is supported on a relatively inert carrier material such as alumina with or without a halogen promoter. The reforming of the feed material employed in the process of this invention is considered nonconventional, as normally practiced with gasoline boiling range materials and is employed specifically for reforming oil feeds obtained as herein provided to form jet, turbine or diesel fuels.

The specifications for turbine fuels vary considerably whether employed by military or commercial aviation, sonic or subsonic operation and the temperature environment in which to be employed. Thus, because of chemical and physical characteristics such turbine fuels have been designated as JP1, JP3, JP4, JP5, JP6, JP8, Jet A, Jet B and Jet A1. These jet fuels are described in the literature as standard and sonic jet fuels. Sonic jet fuels may be found in ASTM Specifications designated D-1655-67T.

The purpose of the combination process of this invention is to provide jet fuel compositions from less than desirable feedstocks to provide kerosene boiling range compositions which are converted in substantial measure by a special catalyst reforming operation to provide jet fuel boiling range compositions.

The specifications for jet fuels are very restrictive with respect to olefin, paraffin, aromatic and naphthene content to provide turbine fuel composition of acceptable freeze point, gravity, heat of combustion and thermal stability. By employing select distillate portions of the oil feed and particularly a shale oil material treated and converted to obtained feed compositions as herein provided, the catalytic reforming step is relied upon to dehydrogenate and cyclize paraffins, hydrogenate olefins and aromatics in combination with producing isoparaffins to provide one or more different and acceptable jet fuel boiling range composition and other turbine fuel compositions. The catalytic reforming operation is preferably effected in the absence of hydrocracking. Thus, the reforming operation of this invention is maintained under conditions to effect the desired reforming of a hydrocarbon charge oil boiling below about 650° F. to particularly produce a turbine fuel composition of desired chemical and physical requirements satisfying the requirements of JP4, JP5, JP8 and others as referenced.

Reforming conditions which may be relied upon to accomplish the reforming operation of this invention include a temperature selected from within the range of 800° F. to about 1100° F. and preferably between about 850° F. and about 950° F., a pressure within the range of 200 to 1000 psig; a liquid hourly space velocity in the range of about 2 to 25 and a hydrogen to oil ratio of about 4:1. The hydrogen produced by dehydrogenation in the reforming operation can be recovered and used in the reforming and hydrotreatment steps of the process thereby reducing the overall amount of externally provided hydrogen which must be obtained from an external hydrogen plant. Typically about 300 SCF/B of hydrogen is produced by the reforming operation of this invention.

The product of catalytic reforming obtained in step 8 is then separated by distillation, step 9, to obtain a turbine fuel boiling range fraction separated from lower boiling material suitable for use as gasoline. The turbine fuel boiling range material obtained from this distillation operation is then subjected to a further mild hydrogenation operation in step 10 in order to selectively saturate excess olefins and aromatic materials in the turbine fuel product.

The hydrogenation operation of step 10 is preferably carried out under relatively mild hydrogenation conditions which reduce the consumption of hydrogen in producing an acceptable turbine fuel product including jet fuel boiling product. Operating conditions include:

a. temperature: from about 500° to 775° F.;

b. pressure: from about 200–700 psig, and a liquid hourly space velocity in the range of 1 to 5 and preferably about 3. The hydrogenation catalyst is preferably a precious metal reforming catalyst such as platinum, palladium and bimetal catalyst distributed on an alumina base, or a catalyst such as disclosed in U.S. Pat. No. 4,049,576, the disclosure of which is incorporated herein by reference thereto. A nickel-molybdenum catalyst similar to the aforedescribed Aero HDS-3 and Aero HDS-3A catalysts may also be used depending on the severity of the operation desired.

The relative amounts of the various products which are taken off as diesel fuel, gasoline and turbine fuel will depend upon the boiling range of the feed processed, its source, practical and economical considerations such as the relative price of the different fuels and more importantly, the particular demand for each of the fuels at any one time. In fact, the combination process of this invention is operated whereby the combustible fuels obtained can include substantial volumes of either diesel fuel or turbine fuel such as jet fuel with a gasoline boiling range material volume varying with operating severity.

Having thus generally described the combination process of the invention and discussed specific steps uniquely contributing thereto, it is to be understood that no undue restrictions are to be imposed by reasons thereof except as defined by the following claims.

We claim:

1. A method for treating oil feeds to maximize the production of middle distillate fuels therefrom which comprises, (a) hydrotreating an oil feed selected from shale oil, coal oil and crude oil comprising sulfur and nitrogen but separated from metal contaminants to remove sulfur and nitrogen therefrom and increase the ratio of basic nitrogen compound to total nitrogen compounds during hydrogen consumption within the range of about 50 to 1200 SCF/B of oil;

(b) distilling the product of step (a) into a first fraction providing an end boiling point in the range of about 600° F. to about 650° F. and a second higher boiling fraction;

(c) catalytically cracking said second higher boiling fraction of step (b) to produce a cracked product of end boiling point within the range of 600° to 650° F.;

(d) contacting said product fractions of steps (b) and (c) with an end boiling point within the range of 600° to 650° F. with an aqueous solution of phosphoric acid whereby basic nitrogen compounds in the oil products are extracted by the phosphoric acid solution;

(e) separating the phosphoric acid solution containing said extracted basic nitrogen compounds from a raffinate oil product, (f) hydrotreating the raffinate oil product of step (e) to hydrogenate olefins, aromatics and nitrogen compounds therein employing hydrogen consumption conditions within the range recited for step (a), (g) separating the hydrotreated product of step (f) to recover high boiling diesel fuel fraction from a fraction suitable for producing jet fuels, (h) passing the fraction suitable for producing jet fuels separated in step (g) to catalytic reforming and recovering an oil product of catalytic reforming reduced in wax forming paraffins but comprising formed aromatics and olefins, (i) separating gasoline product of said reforming step from higher boiling jet fuel boiling range product, and (j) hydrotreating a reformed product comprising jet fuel boiling range material of step (i) sufficient to hydrogenate olefins and aromatics therein, and (k) recovering a hydrogenated product of step (j) suitable for producing jet fuels.

2. The method of claim 1 wherein the inlet feed temperature to the hydrotreating steps is about 350° to about 750° F., the pressure is about 300 to about 2000 psig, and the liquid hourly space velocity is about 0.5 to about 10.

3. The method of claim 1 wherein the temperature for the hydrotreating steps is restricted to within the range of about 600° to about 700° F., the pressure is from about 300 to about 1600 psig, and the liquid hourly space velocity is from about 0.5 to about 10.

4. The method of claim 1 wherein the temperature for the hydrotreating steps is from about 625° to about 675° F., the pressure is up to about 1000 psig, and the liquid hourly space velocity is from 2 to about 3.

5. The method of claim 1 wherein said catalytic reforming is carried out in the presence of one or more noble metal containing catalysts.

6. The method of claim 1 wherein said reforming is carried out in the presence of a bimetal reforming catalyst comprising one of platinum, palladium and rhenium.

7. The method of claim 1 wherein said hydrogenation of reformed product is carried out in the presence of a noble metal containing catalyst.

8. The method of claim 1 wherein said catalytic cracking is carried out at a temperature in the range of about 900° to about 1100° F.

9. The method of claim 1 wherein said catalytic cracking is carried out in the presence of a zeolite catalyst.

10. The method of claim 1 wherein an oil product material boiling up to an end point in the range of 600° to 650° F. initially recovered in the process is counter currently contacted with an aqueous solution of phosphoric acid.

11. The method of claim 10 wherein the aqueous phosphoric acid solution is introduced into the upper part of a contact zone and the oil product material is introduced into the lower portion of a contact zone for countercurrent flow contact therein.

12. The method of claim 1 wherein the amount of acid is at least about 0.3 parts by weight per 100 parts by weight of the oil product being treated.

13. The method of claim 1 wherein the amount of acid is about 0.5 to about 5 parts by weight per 100 parts by weight of the oil product being treated.

14. The method of claim 1 wherein the aqueous solution of phosphoric acid contains from about 5 to about 85 by weight of phosphoric acid.

15. The method of claim 1 wherein the oil feed to the acid extraction contains at least about 2% by weight of olefins.

16. The method of claim 1 wherein a cobalt-molybdate or nickel molybdate catalyst or mixture thereof is employed as a catalyst in the initial hydrotreating step of the process.

17. A method for producing turbine fuels from oil feeds with an end boiling point within the range of about 600° to about 650° F. which comprises, (a) hydrotreating an oil feed free of metals boiling below 650° F. with an amount of hydrogen less than 1200 SCF/B but sufficient to substantially increase the ratio of basic nitrogen compounds to total nitrogen compounds therein and remove within the range of 15 to 30 percent by weight of nitrogen initially present in the oil feed;

(b) separating the hydrotreated oil feed of step (a) to recover a light oil distillate fraction boiling within the range of 285° F. up to about 600° F.;

(c) extracting basic nitrogen compounds from the light oil distillate fraction of step (b) with an aqueous solution of phosphoric acid comprising from 0.5 to about 7 parts by weight of acid per 100 parts by weight of the light oil distillate to produce a raffinate product thereof, (d) hydrotreating said raffinate product of step (c) with an amount of hydrogen in the range of 50 SCF/B up to 1200 SCF/B at temperature and pressure conditions promoting hydrogenation of any olefins and aromatics in the raffinate product of step (c), (e) separating the product of step (d) to recover a hydrogenated product suitable for producing jet and turbine fuels and catalytically reforming said hydrogenated product with a noble metals containing catalyst under condition restricting substantial cracking thereof, (f) separating gasoline from the product of catalytic reforming boiling above gasoline, and (g) hydrotreating the product of step (f) boiling above gasoline to hydrogenate olefins and aromatics therein to produce a turbine fuel including jet fuel boiling range products.

18. A method for converting a heavy crude oil fraction separated from metal contaminants to form light turbine fuels and diesel fuels which comprises:

(a) catalytically cracking a demetalized heavy crude oil fraction boiling above 600° F. or 650° F. under conditions to produce a fraction thereof boiling in the range of 114° F. up to at least 580° F., (b) contacting the oil product of cracking of step (a) and comprising a turbine fuel boiling range fraction with an aqueous solution of phosphoric acid to extract basic nitrogen material from the cracked oil product;

(c) separating an aqueous solution containing extracted basic nitrogen materials from a raffinate oil product of step (b), (d) hydrotreating the raffinate oil product of step (c) to hydrogenate olefins and cyclic compounds of catalytic cracking therein and comprising diesel fuel boiling range material and lower boiling range material suitable for producing lower boiling turbine fuels, (e) separating the product of step (d) into a high boiling diesel fuel material from a lower boiling turbine fuel containing fraction, (f) catalytically reforming said lower boiling turbine fuel of step (e) under conditions of dehydrogenation, cyclization, isomerization and hydrogenation to produce a turbine fuel comprising paraffins, olefins, aromatics and naphthenes, and (g) distilling the product of catalytic reforming of step (f) to separate gasoline from higher boiling reformed product, (h) hydrotreating the higher boiling range product of step (g) sufficient to saturate olefins and aromatics therein to produce a turbine fuel of acceptable freeze point and smoke point, and (i) recovering a hydrotreated turbine oil from step (h).

19. A combination process for upgrading wide boiling range oil fractions obtained from one or more shale oil, coal oil and crude oil to produce diesel and jet fuel boiling range materials which comprises, (a) hydrotreating a demetallized oil fraction comprising one or more component fractions of shale oil, coal oil and crude oil under hydrogen consumptions conditions less than 1200 SCF/B but sufficient to remove sulfur and convert substantial nitrogen compounds therein to basic nitrogen compounds, (b) separating a hydrotreated oil fraction of step (a) into product fractions comprising a first oil fraction boiling up to an end point within the range of 600° to 650° F. and a second higher boiling product fraction, (c) catalytically cracking said second higher boiling fraction of step (b) under conditions to produce a cracked oil product fraction boiling from 114° F. up to an end boiling point within the range of 600° to 650° F. separated from a higher boiling heavy cycle oil product of said cracking, hydrogenating said separated higher boiling heavy cycle oil product and recycling the hydrogenated oil product thereof to said catalytic cracking, (d) extracting oil fractions boiling up to an end boiling point within the range of 600° to 650° F. separated in steps (b) and (c) with a phosphoric acid aqueous solution to particularly remove basic nitrogen compound and produce a raffinate oil product, (e) hydrogenating the raffinate oil product of step (d) and separating hydrogenated diesel oil from a second oil product fraction suitable for forming jet fuel boiling range material, (f) catalytically reforming the second hydrogenated oil product fraction of step (e) under conditions to produce a product rich in jet fuel boiling range materials comprising paraffins, aromatics and naphthenes which preclude micro-crystalline particle formation at desired and predetermined jet fuel freeze point, and (g) recovering a hydrogenated oil product boiling above gasoline suitable for forming jet fuel boiling range product meeting the chemical and physical characteristics of military and commercial jet fuels.

* * * * *